United States Patent [19]

Maximoff

[11] 3,957,338

[45] May 18, 1976

[54] ELECTRICAL TERMINAL CONNECTOR WITH BOWED AND CURVED TINES AND SERRATIONS

[75] Inventor: Paul A. Maximoff, Schaumberg, Ill.

[73] Assignee: Midway Mfg. Co., Franklin Park, Ill.

[22] Filed: June 18, 1975

[21] Appl. No.: 588,019

[52] U.S. Cl. ..... 339/258 R; 339/275 B

[51] Int. Cl.[2] ..... H01R 13/12

[58] Field of Search ..... 339/95 R, 95 D, 258 R, 339/258 P, 275 R, 275 B

[56] References Cited

UNITED STATES PATENTS 2,745,081 5/1956 Offerman ..... 339/258 P 3,553,635 1/1971 Lundergan et al. ..... 339/258 P

*Primary Examiner*—Gerald A. Dost

*Attorney, Agent, or Firm*—Leo J. Aubel; Gerald T. Shekleton; Robert E. Wagner

[57] ABSTRACT

A curved tine terminal for inserting or snapping into a mounted position on a printed circuit board or other supporting surface to be securely retained therein, with the terminal being adapted to receive a plurality of electrical leads and having tines arcuate both along their length and in their cross-section, and serrations in the terminal wall opposite the tines for engaging and securely holding the leads in the terminal in conjunction with the tines.

5 Claims, 9 Drawing Figures

FIG. 1
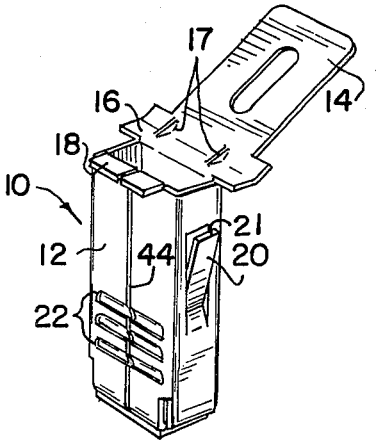
FIG. 2
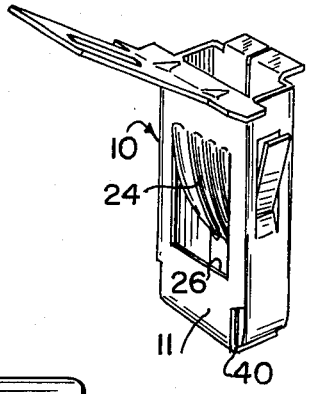
FIG. 3
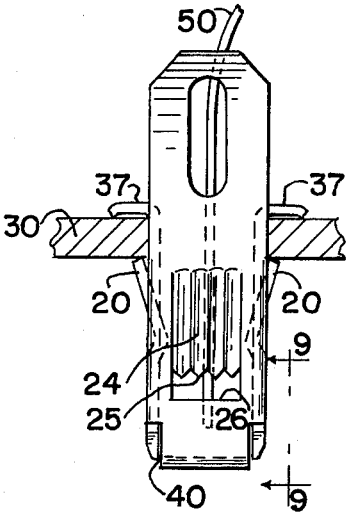
FIG. 4
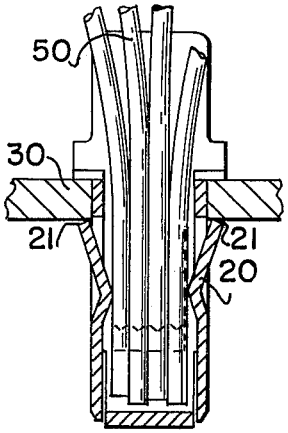
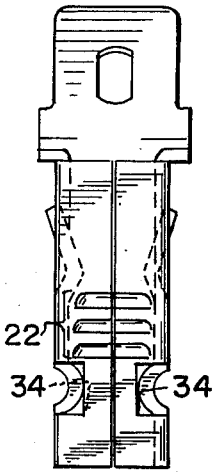
FIG. 5
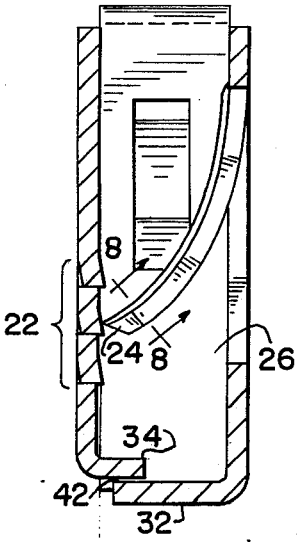
FIG. 7
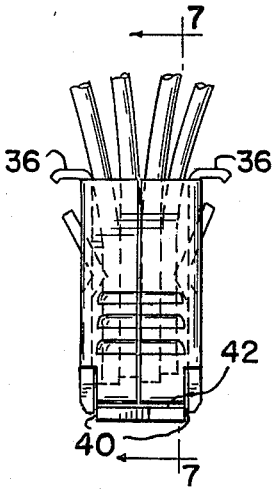
FIG. 6
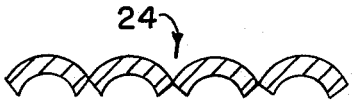
FIG. 8
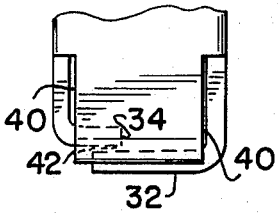
FIG. 9

ELECTRICAL TERMINAL CONNECTOR WITH BOWED AND CURVED TINES AND SERRATIONS

BACKGROUND OF THE INVENTION

This invention is related to Patent Application entitled: "Electrical Terminal Construction", Ser. No. 523,318, filed Nov. 13, 1974.

This invention relates to improvements in electrical terminals of the solder lug or wall type, and is more particularly concerned with providing such terminals with means that will effect a more positive retention of electrical lead wires inserted therein preparatory to dip soldering.

As is well known in the terminal connector art, various structures and expedients have been utilized to mount and retain electrical terminal connectors on the associated bases. Among such structures are screws, rivets, sliding connectors, and clamps or clips of one sort or another. With the advent and now widespread use of printed circuits, and hence, of printed circuit boards, the need has arisen for providing improved terminals for connecting electrical wires or leads for the circuit boards.

Accordingly, the present invention is directed to providing an improved electrical terminal connector particularly suited for use with, or on printed circuit boards (but not necessarily limited thereto), which terminal is adopted to receive from one to five electrical leads or wires of various gauge sizes with the wires being of either stranded or solid construction.

Prior electrical terminals of the solder well type have been provided with wire-gripping fingers and have been reasonably successful in retaining larger gauges of electrical lead wires or bundles of lead wires. Often, however, individual small guage wires must be assembled with the terminals. Practical experience with prior solder well terminals has been a lack of satisfactory retention of the smaller wires so that they tend to become very easily dislodged or even drop out of the terminals in handling incident to various assembly and soldering operations. This apparently comes about because these solder well terminals are made from sheet metal as progressive die stamped and shaped articles in which the retaining fingers are subjected to the usual variables and tolerances which must be expected in any stamped sheet metal product. The forming dies necessarily have various tolerances and are subject to wear. Hence, although the retaining fingers may be produced with reasonable accuracy of wire-retaining convergence, it has been difficult to maintain such close tolerances, accuracy of mutual retaining conjunction of the prong tips, and sharpness for the smaller gauge wires.

It is to the overcoming of the foregoing and other deficiencies and disadvantages of the prior constructions that the present invention is directed. More particularly, by the present invention there is provided effective, highly satisfactory and reliable retention of even the finer gauge wires that have the axial strength to be thrust into engagement within the vertex of the retaining gauges of a solder well terminal. For this purpose the invention provides new and improved wire retaining tines in a solder well terminal.

The terminal connector in the embodiment is formed of spring brass or other suitable material of roughly .010 inches thick. It is preferably pretinned for easy soldering characteristics.

Tines or leaves are formed and positioned in the terminal connector to securely engage a wire inserted therein and windows or openings are formed in the body of the terminal to assure that a path for solder is provided for a firm mechanical and electrical connection between the wires and the terminal connector.

These tines are collectively bowed, that is, form an arc, towards the opposite side in a manner designed to engage even the smaller gauge wires and tightly hold them. This is done by bowing the tines at such a curvature that the end points of the tines preferably come into close contact with the opposite wall of the connector. The tines are preferably composed of four individual prongs with each prong being separate from and yet in close contact with the adjacent prongs. Each individual prong is also formed to be curved in cross section, as will be explained, thereby contributing to the strength and rigidity of the prong. It is because of this strength and rigidity that the wire can be held tightly, and thus be resistant to the removal forces found in the normal handling procedure existing in the assembly of the electrical components of which the terminal is part.

Serrations are also formed in the back of the terminal, much in the fashion of a series of louvers. These serrations serve as a gripping surface for gripping the wire on a side opposite that facing the tines, thereby positively retaining the wire(s) by a pincer-like action on two sides of the wire, by both the tines and the serrations.

The inventive terminal connector may be either manually or automatically inserted or mounted in the associated apertures of the printed circuit board. After insertion of the terminal in the associated boards, the terminal is securely retained therein by a unique lug construction as is described in the above cited U.S. patent aplication, Ser. No. 523,318.

The foregoing and other features and advantages of the invention will be apparent from the following more particular description of the preferred embodiments of the invention, as illustrated in the accompanying drawings wherein:

DESCRIPTION OF THE DRAWINGS

FIG. 1 is an isometric relatively frontal view of the inventive terminal connector.

FIG. 2 is an isometric view of the inventive terminal connector showing a relatively opposite or reverse side to that shown in FIG. 1.

FIG. 3 is a frontal elevational view of an embodiment of the inventive terminal connector mounted on a printed circuit board to more clearly show the construction of the angled resilient arms.

FIG. 4 is a view partially in cross section showing a terminal connector mounted on a printed circuit board and wires inserted in the connector.

FIG. 5 shows a modification of the terminal connector of FIGS. 1–4.

FIG. 6 is a frontal elevational view of another embodiment of the inventive terminal connector.

FIG. 7 is a view in cross section of an embodiment of the present invention showing the curvature of the tines and the serrations on the opposite side.

FIG. 8 is a cross section taken along the lines 8—8 of FIG. 7.

FIG. 9 is a side view showing the construction of the bottom of the present invention.

DESCRIPTION OF THE INVENTION

FIG. 1 shows an embodiment of the present invention as being a terminal connector 10 having a body with a front wall 12, a solder lug 14 and serrations 22. This terminal connector is generally mounted on an associated printed circuit board 30, as shown in FIG. 4. The terminal connector 10 may be retained in the circuit board by means of angled arms 20, which are biased against the circuit board by the tip 21 of the arms 20. Various features of these resilient angled arms are described in the cited application, Ser. No. 523,318.

Flanges or shoulders are provided as support for the connector terminal when placed in the circuit board opening. The tension provided by the angled arms 20 is transmitted by the connector body 10 to the shoulders or flanges through the circuit board opening, thereby holding the connector secure and immovable. The type of shoulder may vary, depending on whether the solder lug is angled (as at 16 and 18 in FIG. 1), straight (as at 37 in FIG. 3), or nonexistent (as at 36 in FIG. 6).

FIG. 2 shows the tines 24 which serve to grasp the wire 50 when inserted for securement thereof. The tines 24 can be better seen in FIG. 7, where it is shown that they are curved in an arcuate shape along their length and extend from the back wall 11 to the opposite side or wall 12, preferably touching the wall 12. The tines 24 have pointed ends 25, as can be seen in FIG. 3. Further, as seen in FIG. 8, which is a cross sectional view taken along the lines 8—8 of FIG. 7, the tines are individually curved, along their cross section. This structure directs the wire upon insertion into the connector 10, in between two of the tines 24 as in FIG. 3, thereby allowing more surface area contact between the tines 24 and each wire 50, which serves to increase the grip of the tines 24 upon the wire 50, thereby holding it more securely. The curvature of the tines 24 and the fact that the tines are made out of spring brass, as mentioned above, all contribute to the holding power on each wire 50.

Further contributing to this holding power on the wire are serrations 22. FIG. 1 shows three of these serrations 22 to be on the front wall 12 of the preferred embodiment of the present invention. A better view of these serrations 22 can be seen in the cross section of FIG. 7 wherein it is shown that these serrations are stamped indentations in the surface of the terminal connector, forming well-defined projecting surfaces on the inside of the terminal connector 10. Thus, when the wire 50 is inserted into this terminal connector and biased by the tines 24 against the inside of the front wall 12 of the terminal connector, the wire is held on both sides — on the one side by the tines 24 and on the other by the projection of the serrations 22.

When a wire is as securely held, as the present invention provides, it can withstand the great agitation prior to the soldering process present in production handling procedures without becoming dissociated from the terminal. Indeed, the soldering process may not even be necessary in that a dependable electrical contact is already present due to the action of the tines 24 and the serrations 22 against the wire 50.

However, should the soldering be desired, the normal and accepted method of applying solder to the surface of the wires in the terminal connector is by dipping into a solder bath. The entrance of solder into the terminal connector of the subject invention is facilitated by its manner of construction. A primary entrance point for the solder is the opening 26 shown in FIG. 7 caused by the striking of the tines and subsequent bending inward. Additional openings 34 may be formed as shown in FIG. 5 should a faster entry of solder be desired.

Further openings are provided in the formation of the bottom of the terminal connector 10 for the influx of solder. In addition to serving as wire stops for wires retained therein, this bottom is formed by bending the front wall 12 at a point under the serrations 22 to roughly a 90° angle thereby formig a partial stop 34 and bending the back wall 11 at an equivalent point over to form the bottom 32 portion, thus overlapping the partial stop 34. As can be seen in FIG. 7, the fitting is not precise and an opening 42 is left between the bottom portion 34 to the stop portions 32. Further openings 38 are shown in FIG. 9. Opening 44 of FIG. 1 is another example of the loose construction of the connector terminal which contributes to the inward flow of solder upon being dipped into a solder bath.

On consideration of the foregoing, it will become obvious that to those skilled in the art, various modifications may be made without departing from the invention embodied herein. Therefore only such limitations should be imposed that are indicated by the spirit and scope of the appended claims.

What is claimed is:

1. A terminal connector for securing electrical lead wires to a base board having opposite surfaces and having apertures extending through the board for accommodating the connector, the connector comprising a hollow body substantially in rectangular tubular form having opposing sides and ends, the body being open at one end thereof for receiving wires and a partially closed opposite end to provide a stop for wires, a plurality of gripping tines positioned substantially on the same plane extending from a first side surface of the rectangular body and extending in converging cantilever relation toward the opposite side surface and away from the opening, flanges extending from the body arranged to engage one surface of the base board adjacent the aperture to position the terminal connector, and resilient cantilever lugs for firmly abutting and engaging the opposite side of base boards of varying thicknesses, wherein the improvement comprises said tines converging toward the opposite side in a convex manner, the converging ends of the tines being positioned adjacent and touching said opposite side surface and are arcuately shaped along their cross section to firmly engage wires inserted into said body.

2. The terminal connector of claim 1 wherein serrations are formed on said opposite side surface and said converging tines extending in convex manner, said arcuately shaped tines acting in combination with said serrations to better grip a wire inserted therein.

3. The terminal connector of claim 2 wherein the serrations are formed in such a manner as to present a well-defined edge on the opposite side surface.

4. The terminal connector of claim 2 wherein said converging tines extend to the opposite side surface in such a manner as to contact said serrations.

5. The terminal connector of claim 1 wherein the connector is formed of spring brass.

* * * * *